United States Patent [19]

Fastner et al.

[11] 3,991,815

[45] Nov. 16, 1976

[54] CASTING TUBE WITH A BOTTOM OPENING FOR CONTINUOUSLY CASTING STEEL STRANDS

[75] Inventors: Thorwald Fastner; Baldur Schramböck, both of Linz, Austria

[73] Assignee: Vereinigte Osterreichische Eisen- und Stahlwerke - Alpine Montan Aktiengesellschaft, Linz, Austria

[22] Filed: June 20, 1975

[21] Appl. No.: 588,810

[30] Foreign Application Priority Data

June 25, 1974 Austria ..... 5235/74

[52] U.S. Cl. ..... 164/281 R; 164/337; 222/566

[51] Int. Cl.[2] ..... B22D 11/10

[58] Field of Search ..... 164/281, 337; 138/44; 222/566

[56] References Cited

UNITED STATES PATENTS

| | | | |
|---|---|---|---|
| 2,361,150 | 10/1944 | Petroe | 8/156 |
| 2,501,593 | 3/1950 | Becker | 138/44 |
| 3,300,950 | 1/1967 | Carle | 55/199 |
| 3,459,346 | 8/1969 | Tennis | 164/337 |
| 3,578,064 | 5/1971 | Mills | 164/281 |
| 3,888,294 | 6/1975 | Fastner et al. | 164/281 X |
| 3,908,735 | 9/1975 | DiCandia | 164/281 X |

FOREIGN PATENTS OR APPLICATIONS

| | | | |
|---|---|---|---|
| 505,082 | 10/1951 | Belgium | 138/44 |
| 1,542,950 | 10/1968 | France | 164/281 |
| 2,105,881 | 8/1972 | Germany | 164/281 |

*Primary Examiner*—Ronald J. Shore
*Attorney, Agent, or Firm*—Brumbaugh, Graves, Donohue & Raymond

[57] ABSTRACT

A casting tube with a bottom opening for continuously casting steel strands, in particular billets with dimensions of 300 × 150 to 500 × 300 mm, comprising a converging-diverging end part forming a necking and at least two upwardly inclined lateral outlet openings thus providing for a controlled braking of the flow of steel in the mould. Advantageously, the cross-sectional reduction in the converging part to the necking is 30 to 70 %. The casting tube may be constructed in one piece and have, at its inflow-side, an opening for supplying flush gas.

5 Claims, 5 Drawing Figures

CASTING TUBE WITH A BOTTOM OPENING FOR CONTINUOUSLY CASTING STEEL STRANDS

Figure 1:
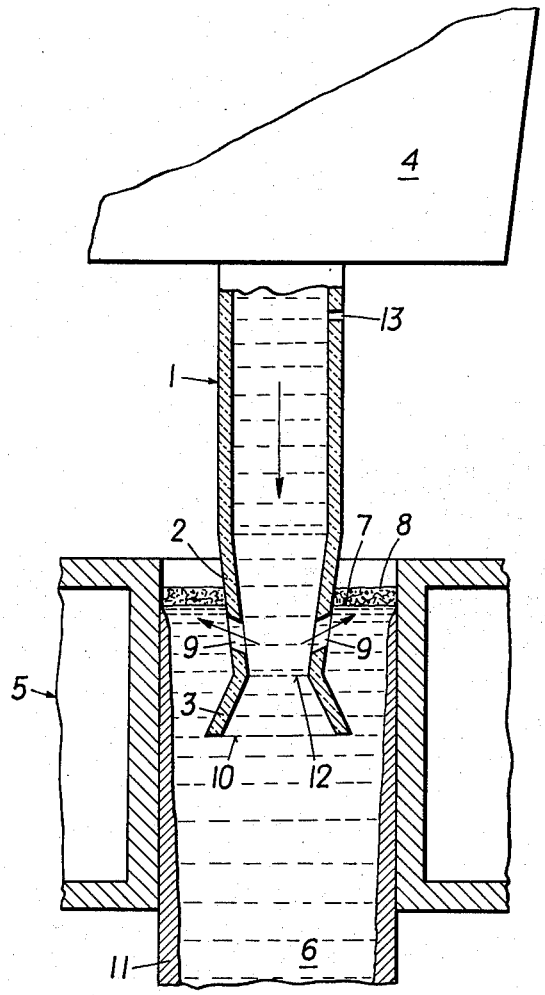

The invention relates to a casting tube with a bottom opening for the continuous casting of steel strands, in particular for the casting of billets with dimensions of 300 × 150 to 500 × 300 mm.

Casting tubes used for the casting of steel strands have the purpose of withholding the oxygen of the air from the steel stream and preventing oxidations. Furthermore, the flow of the steel in the mould is to be controlled: The stream emerging in the mould below the level of the bath ought not to penetrate too deeply into the sump of the strand, in order to keep low the danger of a rupture of the strand skin, but also a flow in the direction towards the end walls (narrower walls) of the mould ought to be not too strong, because otherwise local melting of the strand skin might occur. On the other hand a certain flow should be present at the front of solidification which prevents inclusions from accumulating in the edge zone of the cast product and causing a poor surface. A flow in the mould is also necessary to prevent the formation of a top crust. The desired controlling or regulation, respectively, of the flow is especially difficult when high-grade strands are cast in the above mentioned billet measurements with pure edge zones at relatively high casting capacities between about 0.8 and 1.5 metric tons/min, because then the amount of steel supplied is relatively large as compared to the volume of the mould.

Known casting tubes do not sufficiently meet the above mentioned requirements. In casting tubes with a downwardly directed bottom opening the downward flow is too strong, and thus the penetration into the sump too deep, while the flow is too slight in the upper part of the mould. On the other hand, with casting tubes with lateral outlets there is often the difficulty that the skin growth at the narrow sides of the cast product is disturbed, and, depending on the inclination of the axes of the outlets, the flow in the upper part of the mould is too strong or too slight.

The invention aims at preventing the above described disadvantages and difficulties and has as its object to create a casting tube for the continuous casting of steel strands which enables the desired controlled flow at the bottom opening of the casting tube in the lower part of the mould as well as in the upper part without disturbing the formation of the strand skin.

According to the invention this object is achieved in that the casting tube has a converging-diverging end part wherein at least two lateral outlet openings are provided above the necking.

Advantageously, the axes of the lateral outlet openings are directed upwardly inclined.

According to a preferred embodiment, the cross-sectional reduction in the converging part to the necking amounts to 30 to 70 %.

The use of a casting tube according to the invention enables the casting of strands with an especially pure edge zone. It is suited for the casting of strands with a relatively high casting capacity, for instance small-size billets of 300 × 150 mm to 500 × 300 mm for a casting capacity of about 0.8 to about 1.5 metric tons/min.

From strands which have been cast by using the casting tubes of the invention thin strips with high-quality surfaces can be produced without requiring a surface treatment by flame scarfing.

The converging part of the casting tube of the invention causes a backpressure and causes together with the dimensioning of the lateral outlet openings the desired control of the flow in the upper part of the mould. The most favorable flow conditions are achieved when the cross-sectional reduction in this part to the necking amounts to 30 to 70 %. Furthermore it is suitable that the cross-sectional area of all the lateral outlet openings is at least the size of the cross-sectional area at the transition (necking) between the converging and the diverging parts of the casting tube. By means of the diverging part of the casting tube the flow conditions desired in the lower part of the mould are adjusted. In this part the speed of the steel stream is reduced.

In order that the invention may be more fully understood, examples of casting tubes will now be explained in the drawings, in which FIGS. 1 to 5 show vertical sections of five different embodiments.

According to FIG. 1 the casting tube consists of the cylindrical part 1, the converging part 2 and the diverging part 3. The casting tube is inserted into the bottom of the tundish 4 and with its end part it reaches into the mould 5, where it is immersed below the surface of the molten steel 6. The casting level 7 is covered with casting powder 8. In the converging part below the casting level are the lateral outlets 9 whose axes are directed upwardly inclined. Their total cross-sectional area is about equal to the cross-section of the necking between the converging part 2 and the diverging part 3. The lower bottom opening is denoted with 10. At the cooled walls of the reciprocating mould the strand skin 11 forms; the strand is continuously extracted from the mould. The casting level is held constant by subsequently inflowing steel.

The cross-section of the casting tube at the transition between the converging part and the diverging part which is essential for adjusting the moderated flow is denoted with 12. Preferably it ought to be 30 to 70 % smaller than cross-section 1. However, this area ought to be at least 9 $cm^2$; thus any danger of a "growing-together" is prevented.

Due to the above described configuration of the casting tube with an adaptation of the directions of the emerging streams through the three outlets a braking effect is achieved in the lower part of the mould which eliminates the danger of a rupture, while in the upper part a slight flow or turbulence is maintained, in such a way that the skin growth is not impaired, but inclusion parts are prevented from accumulating at the front of solidification.

In the cylindrical part 1 an opening 13 can be provided for the supplying of flush gas. The flushing with inert gas causes a purification of the steel so that the inclusion content is low in the core — as well as in the edge zone of the cast product.

The casting tubes of the invention can — as shown — be formed as one piece or they can consist of several pieces.

Figure 2:
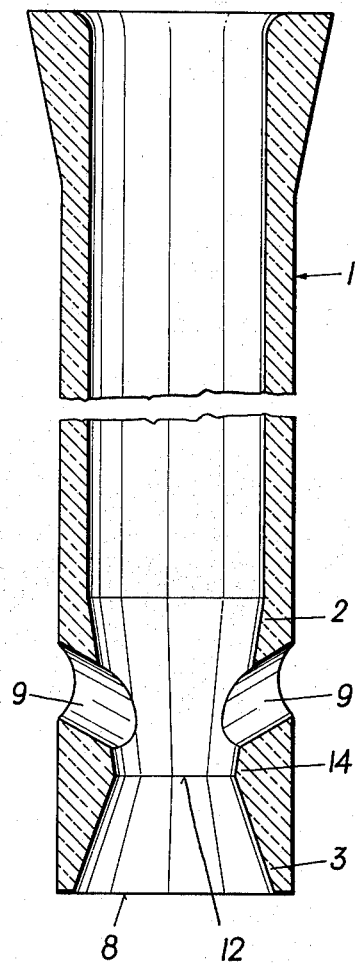

According to the embodiment of FIG. 2 the necking is formed by a thickened inwardly-protruding wall-part 14, while the outside of the casting tube is cylindrically shaped. Thus the outside does not follow the cross-sectional reduction which has the advantage that the lateral outlet channels 9 are longer than in FIG. 1 and thus a better guiding or directing effect, respectively, of the steel streams emerging through the lateral openings is achieved.

Figure 3:
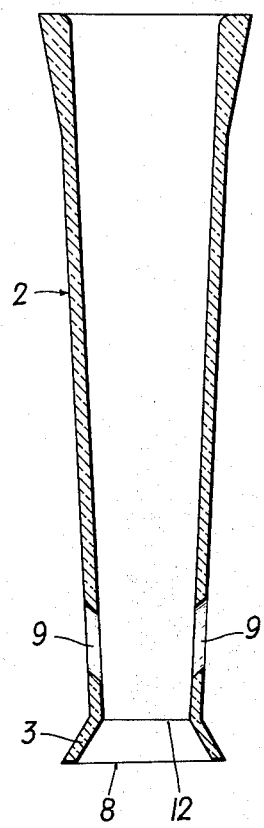

In the embodiment according to FIG. 3 the cylindrical piece 1 has been left out; the tube only consists of the converging part 2 and the diverging part 3, which form one piece.

Figure 4:
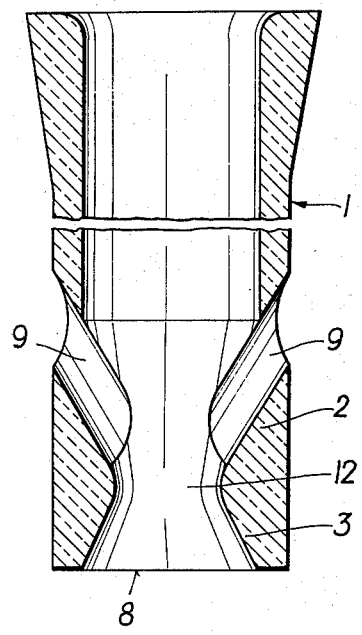

In the embodiment according to FIG. 4 the converging part is relatively short and the outlet channels 9 have about the same direction as the convergency so that the channels extend over the entire length of this backpressure part.

Figure 5:
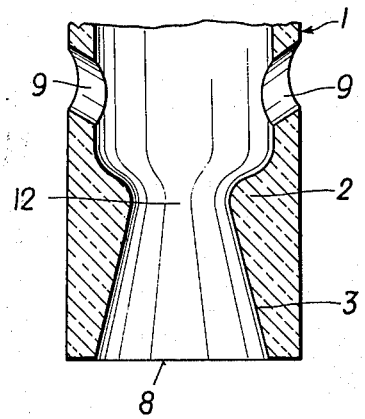

In the embodiment according to FIG. 5 the lateral outlet channels are above the necking 12 in the cylindrical part 1 while the converging part 2 is short.

What we claim is:

1. In a continuous casting apparatus for continuously casting steel strands, in particular billets with dimensions of between 300 × 150 mm and 500 × 300 mm, the improvement comprising a casting tube with a bottom opening, an end part composed of a converging portion and a diverging portion forming a necking therebetween, and at least two lateral outlet openings arranged above said necking.

2. The continuous casting apparatus as set forth in claim 1, wherein said lateral outlet openings are directed upwardly inclined.

3. The continuous casting apparatus as set forth in claim 1, wherein in said converging portion to said necking there is a cross-sectional reduction of between 30 and 70 %.

4. The continuous casting apparatus as set forth in claim 1, wherein said casting tube is formed as one piece.

5. The continuous casting apparatus as set forth in claim 1, wherein said casting tube further comprises at its inflow-side an opening for supplying flush gas.

* * * * *